US007524003B2

(12) United States Patent
Liu

(10) Patent No.: US 7,524,003 B2
(45) Date of Patent: Apr. 28, 2009

(54) CABINET WITH A SAFETY DEVICE

(76) Inventor: George C. M. Liu, No. 96, Sec. 3, Yun-Ke Road, Dou-Liou City, Yunlin Hsien (TW)

( * ) Notice: Subject to any disclaimer, the term of this patent is extended or adjusted under 35 U.S.C. 154(b) by 119 days.

(21) Appl. No.: 11/618,768

(22) Filed: Dec. 30, 2006

(65) Prior Publication Data

US 2008/0157642 A1 Jul. 3, 2008

(51) Int. Cl.
*E05C 7/06* (2006.01)

(52) U.S. Cl. ..... 312/221; 312/217

(58) Field of Classification Search ..... 312/215–221, 312/107.5; 70/78–87; 292/DIG. 18
See application file for complete search history.

(56) References Cited

U.S. PATENT DOCUMENTS 3,560,068 A * 2/1971 Ostrom ..... 312/217
4,352,529 A * 10/1982 Steinke ..... 312/222
4,452,498 A * 6/1984 Wood et al. ..... 312/216
4,804,876 A * 2/1989 Lannert et al. ..... 312/221
5,720,535 A * 2/1998 Mehman ..... 312/219
5,862,689 A * 1/1999 Wen ..... 312/219
6,347,848 B1 * 2/2002 Cho ..... 312/219
6,374,649 B1 * 4/2002 Holcomb et al. ..... 312/215

* cited by examiner

*Primary Examiner*—Hanh V Tran
(74) *Attorney, Agent, or Firm*—Pai Patent & Trademark Law Firm; Chao-Chang David Pai

(57) ABSTRACT

A cabinet includes a cabinet body, multiple drawers and a safety device. The drawers are mounted moveably in the cabinet body. The safety device is mounted in the cabinet body and has a control member and multiple hook members. The control member is mounted on the rear panel of the cabinet body and has a supporting base, a pivotal member and a resilient element. The pivotal member is mounted pivotally on the supporting base. The resilient element is connected to the supporting base and the pivotal member. The hook members are mounted respectively on the drawers and are aligned with the pivotal member. When a drawer is opened, the corresponding hook member pushes the pivotal member to pivot the pivotal member and stretch the resilient element and a hook flange on the pivotal member engages the hook members on other drawers to prevent other drawers from being opened.

8 Claims, 9 Drawing Sheets

CABINET WITH A SAFETY DEVICE

BACKGROUND OF THE INVENTION

1. Field of Invention

The present invention relates to a cabinet, and more particularly to a cabinet with a safety device that can improve safety of the cabinet when a drawer is opened.

2. Description of the Related Art

A conventional cabinet with multiple drawers may be used to classify objects into different groups by putting objects having similar characteristics into a corresponding drawer. For example, hand tools, electrical tools and fasteners can be classified by putting them respectively into drawers of a tool cabinet. However, when drawers of the conventional cabinet load objects, each drawer may bear a heavy weight. When a drawer is pulled, other drawers may be brought out to escape from the conventional cabinet. When several drawers are opened at the same time, the conventional cabinet may collapse down to hurt people and damage objects held in the conventional cabinet.

To overcome the shortcomings, the present invention provides a cabinet with a safety device to mitigate or obviate the aforementioned problems.

SUMMARY OF THE INVENTION

The primary objective of the present invention is to provide a cabinet with a safety device that can improve safety of the cabinet when a drawer is opened.

A cabinet in accordance with the present invention comprises a cabinet body, multiple drawers and a safety device. The cabinet body comprises a rear panel, two side panels and a top panel. The rear panel has an inner surface, a top and a bottom. The side panels are mounted on the rear panel and each side panel has a top end. The top panel is mounted on the top ends of the side panels.

The drawers are mounted moveably in the cabinet body.

The safety device is mounted in the cabinet body and comprises a control member and multiple hook members. The control member is mounted on the rear panel and comprises a supporting base, a pivotal member and a resilient element. The supporting base is mounted on the inner surface of the rear panel and has a supporting body, a top flange and a bottom flange. The supporting body is attached to the inner surface of the rear panel, extends from the top to the bottom of the rear panel and has a top end and a bottom end. The top flange is mounted on the top end of the supporting body and has a front edge. The bottom flange is mounted on the bottom end of the supporting body and has a top surface.

The pivotal member has a V-shaped cross-section, is mounted pivotally on the supporting base and comprises a guide sheet, a hook sheet and an included angle. The guide sheet has a top edge and a bottom edge. The hook sheet is attached to the guide sheet and has an outer edge, a top edge and a bottom edge. The hook flange is formed on the outer edge of the hook sheet.

The resilient element has a positioning end and a guide end. The positioning end is connected to the supporting base. The guide end is connected to the pivotal member.

The hook members are mounted respectively on the drawers and aligned with the pivotal member and each hook member comprises a short protrusion, a long protrusion, a hook protrusion and a pushing protrusion. The short protrusion extends toward the rear panel and has a rear end. The long protrusion extends toward the rear panel and has a rear end. The hook protrusion is mounted on the rear end of the short protrusion. The pushing protrusion is mounted on the rear end of the long protrusion and extends between the supporting base and the pivotal member.

When a drawer is opened, the pushing protrusion on a corresponding hook member pushes the hook sheet of the pivotal member to pivot the pivotal member and stretch the resilient element and the hook flange on the hook sheet engages the hook protrusions on hook members on other drawers. When an opened drawer is closed, the pushing protrusion on the corresponding hook member pushes the guide sheet of the pivotal member to pivot the pivotal member and the hook flange on the hook sheet disengages from the hook protrusions on hook members on other drawers.

Other objectives, advantages and novel features of the invention will become more apparent from the following detailed description when taken in conjunction with the accompanying drawings.

DETAILED DESCRIPTION OF THE INVENTION

Figure 1:
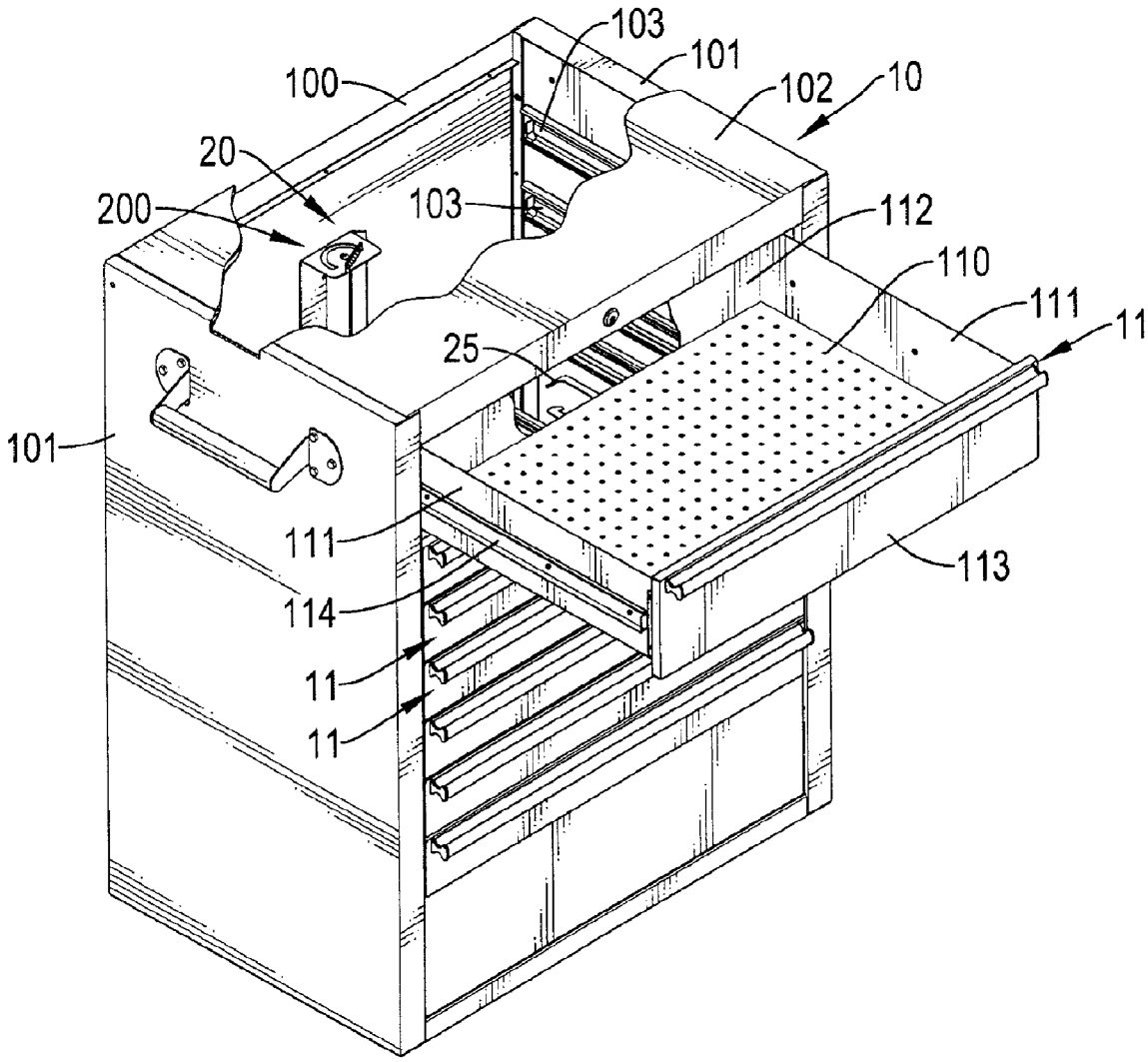
FIG. 1 is a perspective view in partial section of a cabinet in accordance with the present invention.

With reference to FIG. 1, a cabinet in accordance with the present invention comprises a cabinet body (10), multiple drawers (11) and a safety device (20). The cabinet body (10) comprises a rear panel (100), two side panels (101), a top panel (102) and multiple pairs of drawer holders (103). The rear panel (100) has two side edges, an inner surface, a top and a bottom. The side panels (101) are mounted respectively on the side edges of the rear panel (100) and each side panel (101) has a top end and an inner surface. The top panel (102) is mounted on the top ends of the side panels (101). Each pair of drawer holders (103) are mounted respectively on the inner surfaces of the side panels (101) and are aligned with each other.

The drawers (11) are mounted moveably in the cabinet body (10) and each drawer (11) has a bottom board (110), two side boards (111), a rear board (112), a front board (113) and two hangers (114). The bottom board (110) has two side edges, a rear edge and a front edge. The side boards (111) are mounted respectively on the side edges of the bottom board (110) and each side board (111) has an outer surface. The rear board (112) is mounted on the rear edge of the bottom board (110). The front board (113) is mounted on the front edge of the bottom board (110). The hangers (114) are mounted respectively on the outer surfaces of the side boards (11), correspond to and are mounted slidably and respectively on a corresponding pair of drawer holders (103) on the cabinet body (10).

Figure 2:
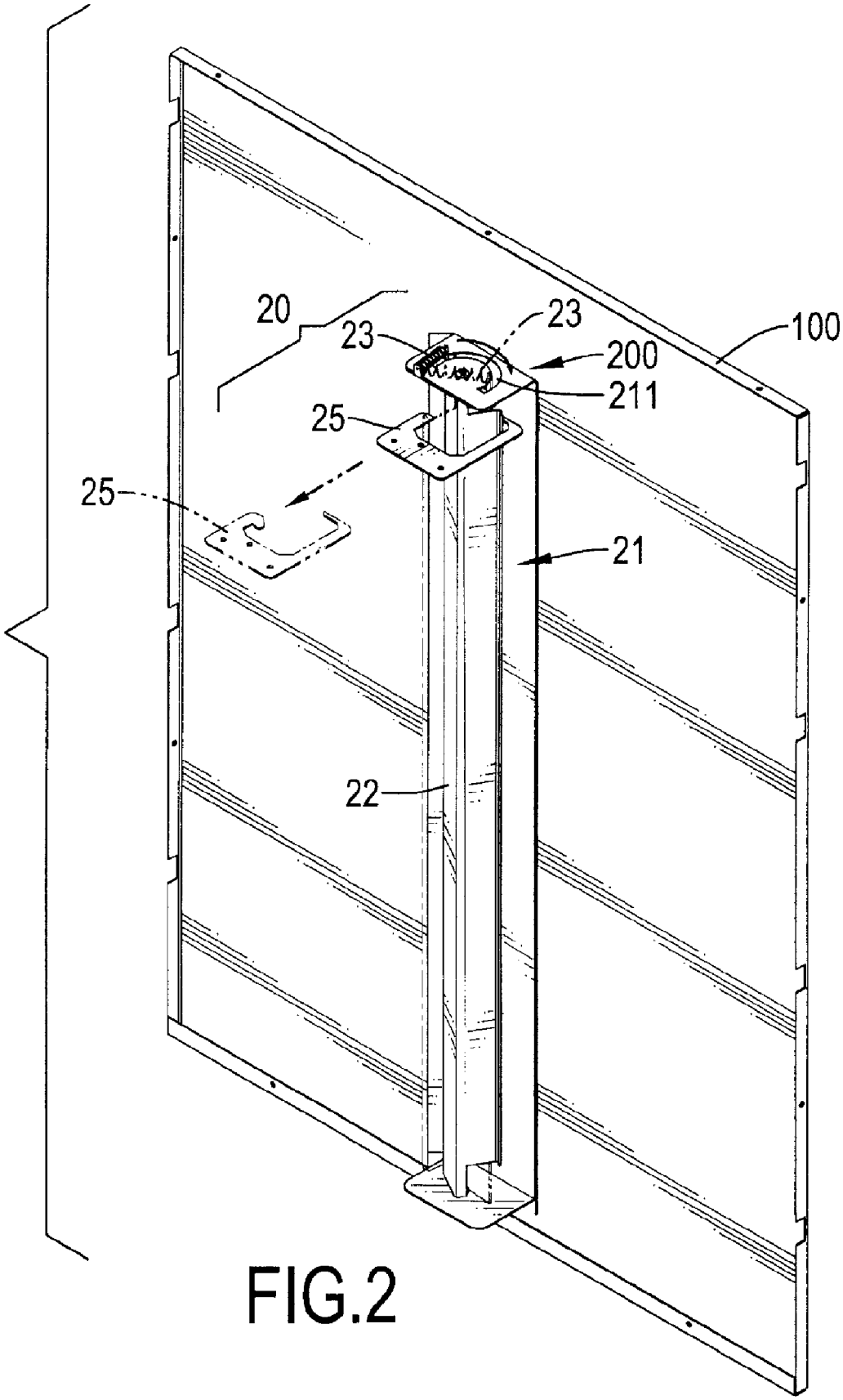
FIG. 2 is an operational perspective view of the safety device of the cabinet in FIG. 1.
Figure 3:
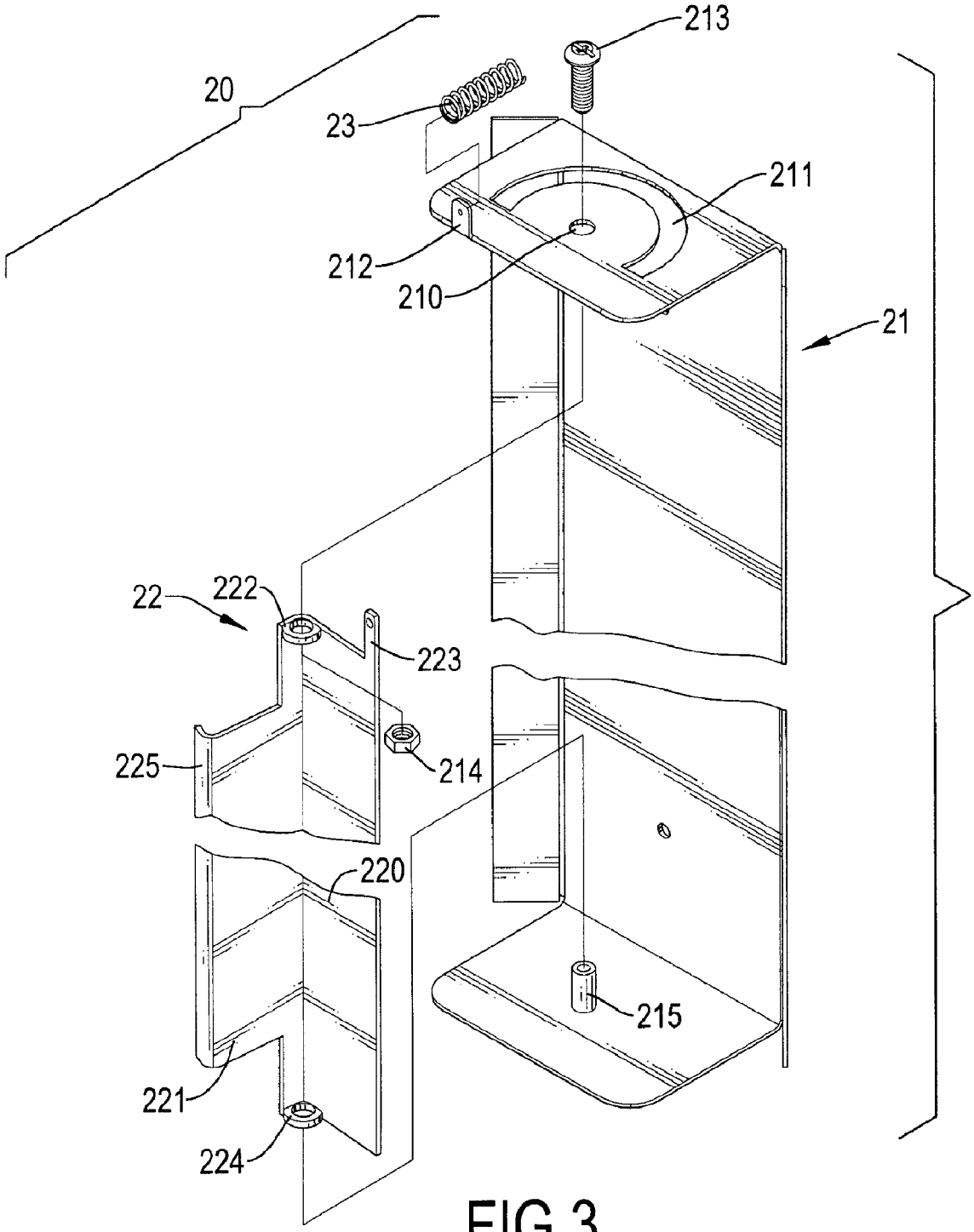
FIG. 3 is an exploded perspective view of the safety device of the cabinet body in FIG. 1.

With further reference to FIGS. 2 and 3, the safety device (20) is mounted in the cabinet body (10) and comprises a control member (200) and multiple hook members (25). The control member (200) is mounted on the rear panel (100) and comprises a supporting base (21), a pivotal member (22), a resilient element (23), a bolt (213) and a nut (214). The supporting base (21) is mounted on the inner surface of the rear panel (100) and has a supporting body, a top flange, a bottom flange, a pivotal hole (210), a guide slot (211), a positioning protrusion (212) and a stud (215). The supporting body is attached on the inner surface of the rear panel (100), extends from the top to the bottom of the rear panel (100) and has a top end and a bottom end. The top flange is mounted on the top end of the supporting body and has a front edge. The bottom flange is mounted on the bottom end of the supporting body and has a top surface. The pivotal hole (210) is defined through the top flange. The guide slot (211) is semi-circular, is defined through the top flange and extends around the pivotal hole (210). The positioning protrusion (212) is formed on the front edge of the top flange. The stud (215) is formed on the top surface of the bottom flange and is aligned with the pivot hole (210) in the top flange.

The pivotal member (22) has a V-shaped cross-section, is mounted pivotally on the supporting base (21) and comprises a guide sheet (220), a hook sheet (221), a top holder (222), a bottom holder (224), a guide protrusion (223), a hook flange (225) and an included angle. The guide sheet (220) has an inner edge, a top edge and a lower edge. The hook sheet (221) is connected to the guide sheet (220) and has an inner edge, an outer edge, a top edge and a bottom edge. The inner edge of the hook sheet (221) is attached to the inner edge of the guide sheet (220). The top holder (222) is mounted between the top edges of the guide sheet (220) and the hook sheet (221) and is aligned with the pivotal hole (210) in the top flange. The bottom holder (224) is mounted between the bottom edges of the guide sheet (220) and the hook sheet (221) and holds the stud (215) on the bottom flange. The guide protrusion (223) is formed on the top edge of the guide sheet (220) and is mounted moveably in the guide slot (211) in the top flange. The hook flange (225) is formed on the outer edge of the hook sheet (221). The included angle is defined between the guide sheet (220) and the hook sheet (221).

Figure 4:
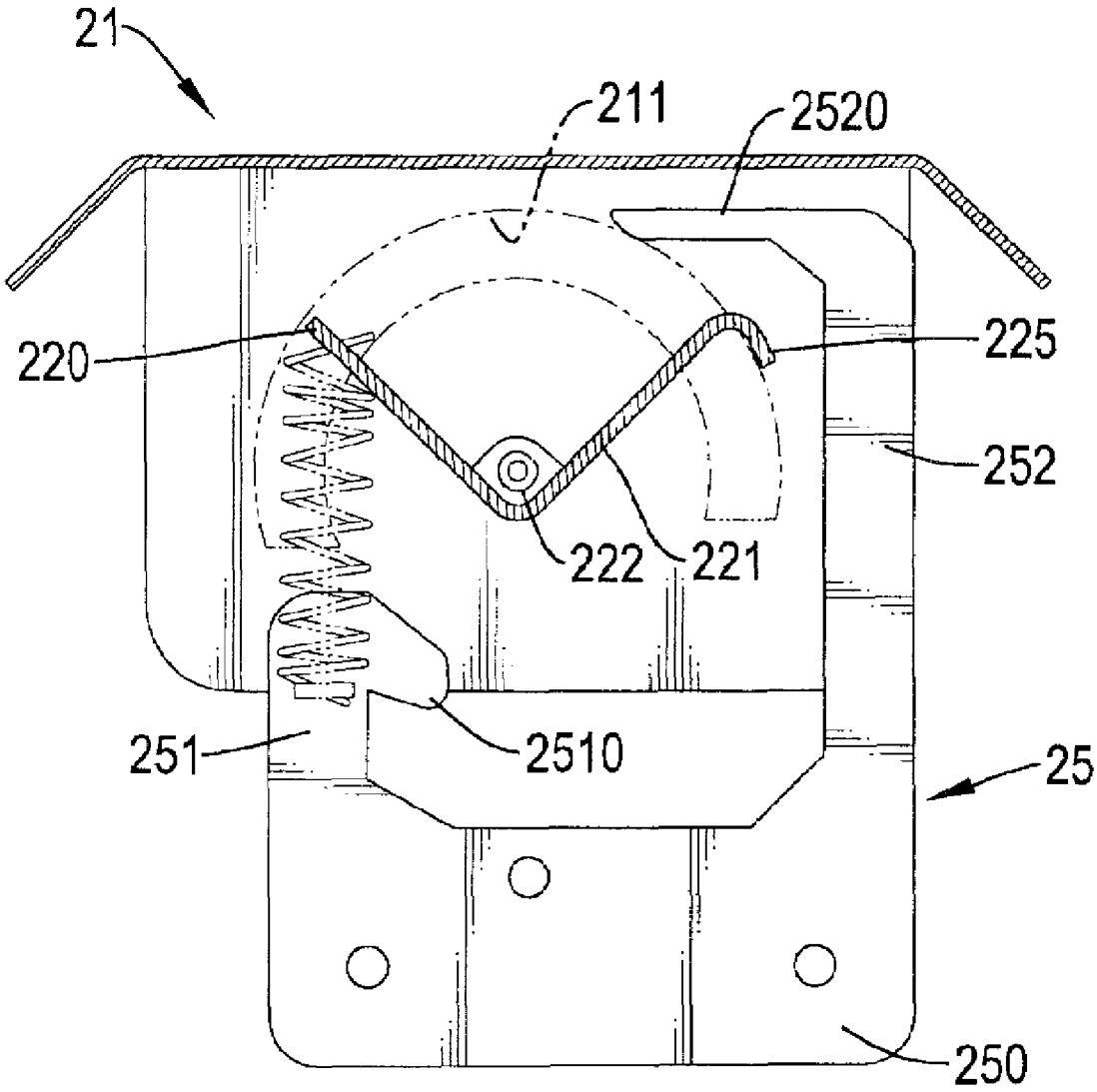
FIG. 4 is a top view in partial section of the safety device of the cabinet in FIG. 1 with the door being detached from the cabinet body.

The resilient element (23) has a positioning end and a guide end. The positioning end is connected to the positioning protrusion (212) on the top flange on the supporting base (21). The guide end is connected to the guide protrusion (223) on the guide sheet (220) of the pivotal member (22). With further reference to FIG. 4, before the resilient element (23) is stretched, the included angle of the pivotal member (22) faces the rear panel (100) of the cabinet body (10).

The bolt (213) is mounted in and extends through the pivotal hole (210) in the top flange and the top holder (222) on the pivotal member (22). The nut (214) is screwed on the bolt (213) so the pivotal member (22) is mounted pivotally on the supporting base (21).

The hook members (25) are mounted respectively on the drawers (11) and are aligned with the pivotal member (22). When all drawers (11) are closed, the hook members (25) are disposed near the pivotal member (22). Each hook member (25) comprises a connecting base (250), a short protrusion (251), a long protrusion (252), a hook protrusion (2510) and a pushing protrusion (2520). The connecting base (250) is mounted on the bottom board (110) of a corresponding drawer (11) and has a hook side and a pushing side. The short protrusion (251) is mounted on the hook side of the connecting base (250), extends toward the rear panel (100) and has a rear end. The long protrusion (252) is mounted on the pushing side of the connecting base (250), extends toward the rear panel (100) and has a rear end. The hook protrusion (2510) is mounted on the rear end of the short protrusion (251) and faces the connecting base (250). The pushing protrusion (2520) is mounted on the rear end of the long protrusion (252), faces the connecting base (250) and extends between the supporting base (21) and the pivotal member (22) when the corresponding drawer (11) is closed.

Figure 5:
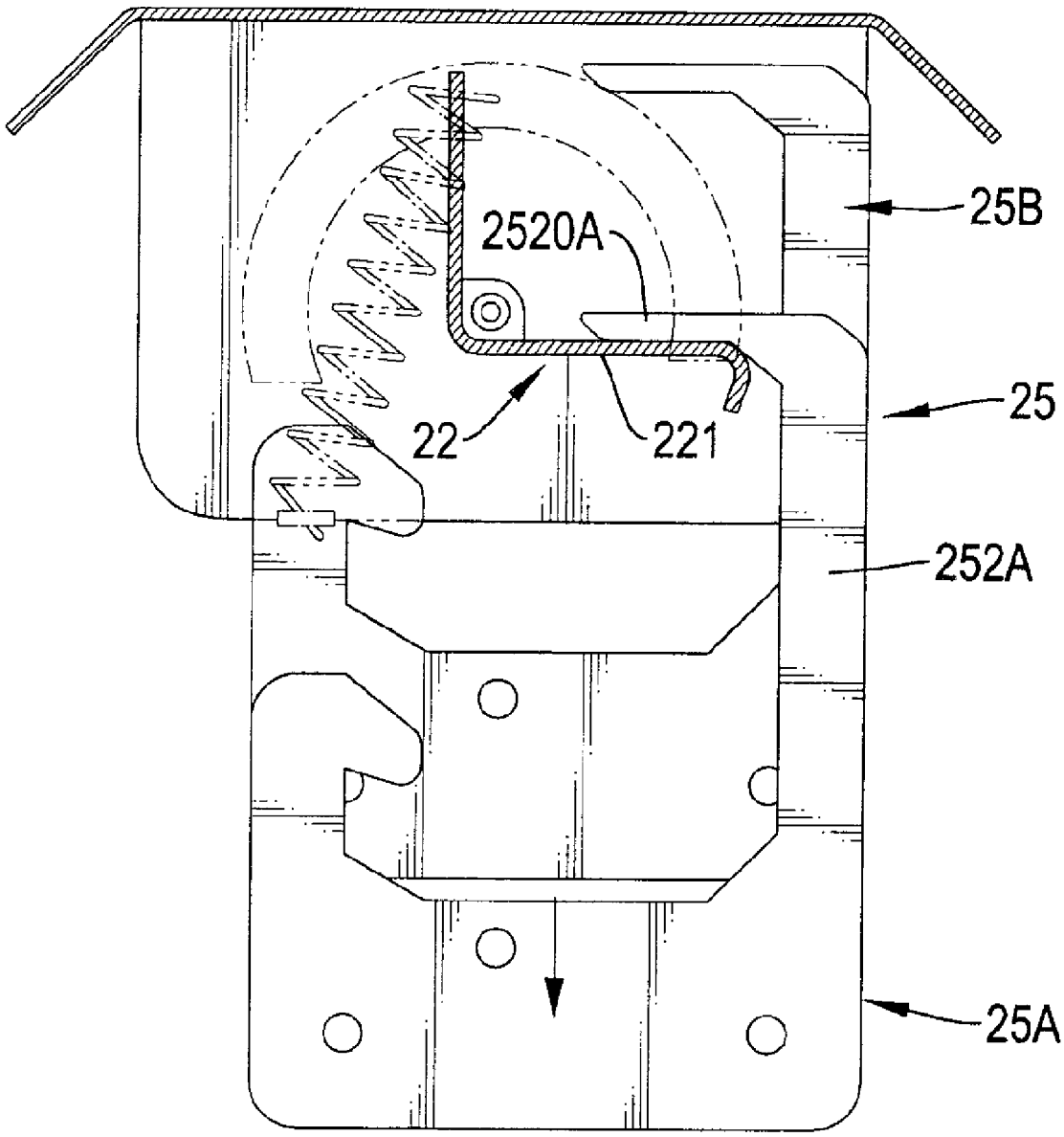
FIG. 5 is an operational top view in partial section of the safety device of the cabinet in FIG. 1.
Figure 6:
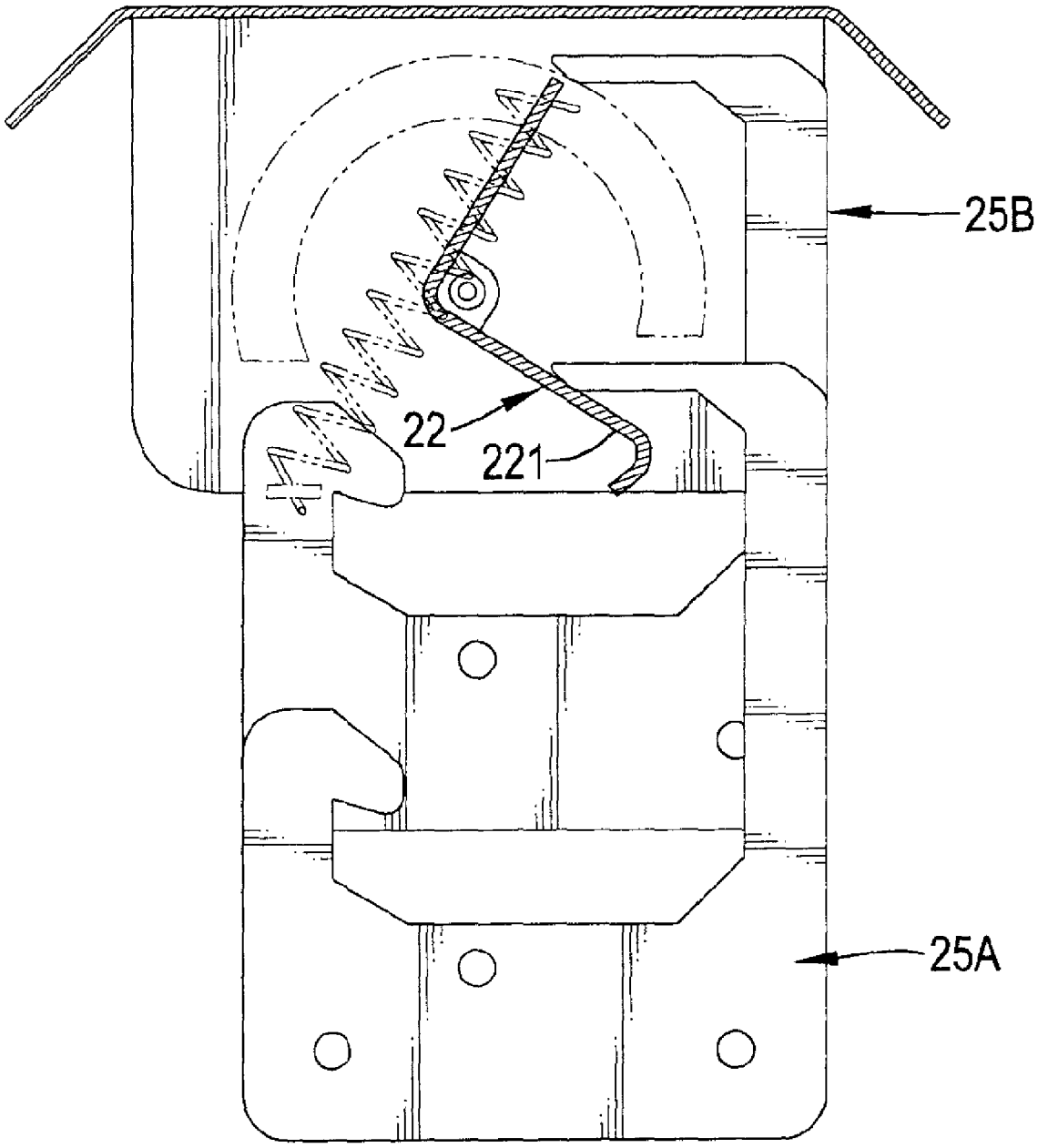
FIG. 6 is an operational top view in partial section of the safety device of the cabinet in FIG. 1.
Figure 7:
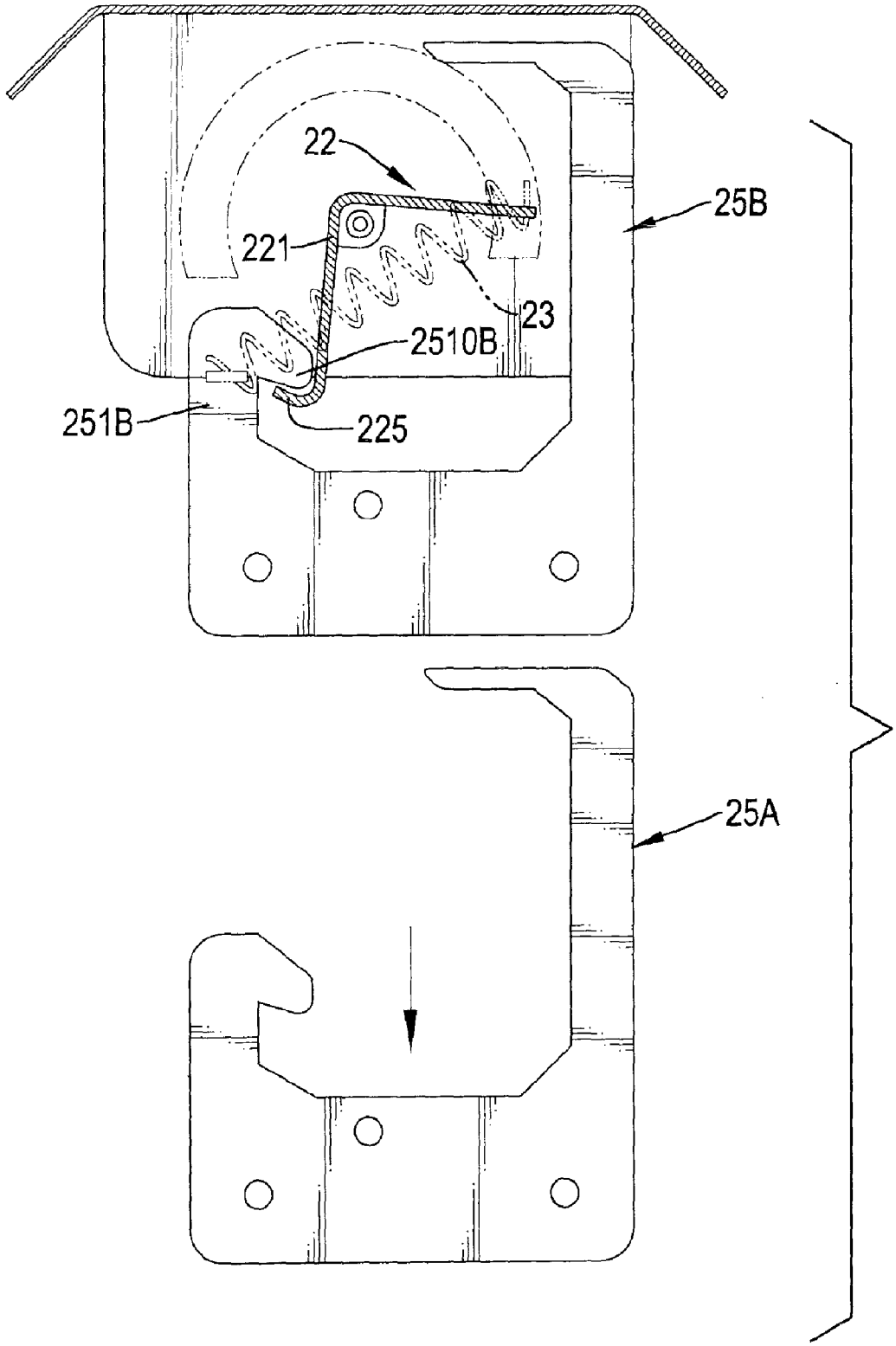
FIG. 7 is an operational top view in partial section of the safety device of the cabinet in FIG. 1.

With reference to FIGS. 5, 6 and 7, operation of the safety device (20) is described as following. For explaining the operation of the safety device (20), a hook member (25) on an opened drawer is numbered as 25A and hook members (25) on other closed drawers are numbered as 25B. When a drawer (11) is opened, the pushing protrusion (2520A) on the long protrusion (252A) on the hook member (25A) pushes the hook sheet (221) of the pivotal member (22) to pivot the pivotal member (22). With the pivotal rotation of the pivotal member (22), the hook flange (225) on the hook sheet (221) engages the hook protrusions (2510B) on the short protrusions (251B) of the hook members (25B) on other drawers (11) to prevent other drawers (11) from being opened. The guide sheet (220) is also pivoted and the resilient element (23) is stretched to prevent the hook flange (225) from escaping from the hook members (25B) on other drawers (11). So, other drawers (11) are kept from opening by the pivotal member (22) and only one drawer (11) can be opened at a time. Accordingly, the cabinet does not collapse easily and safety of using the cabinet is improved.

Figure 8:
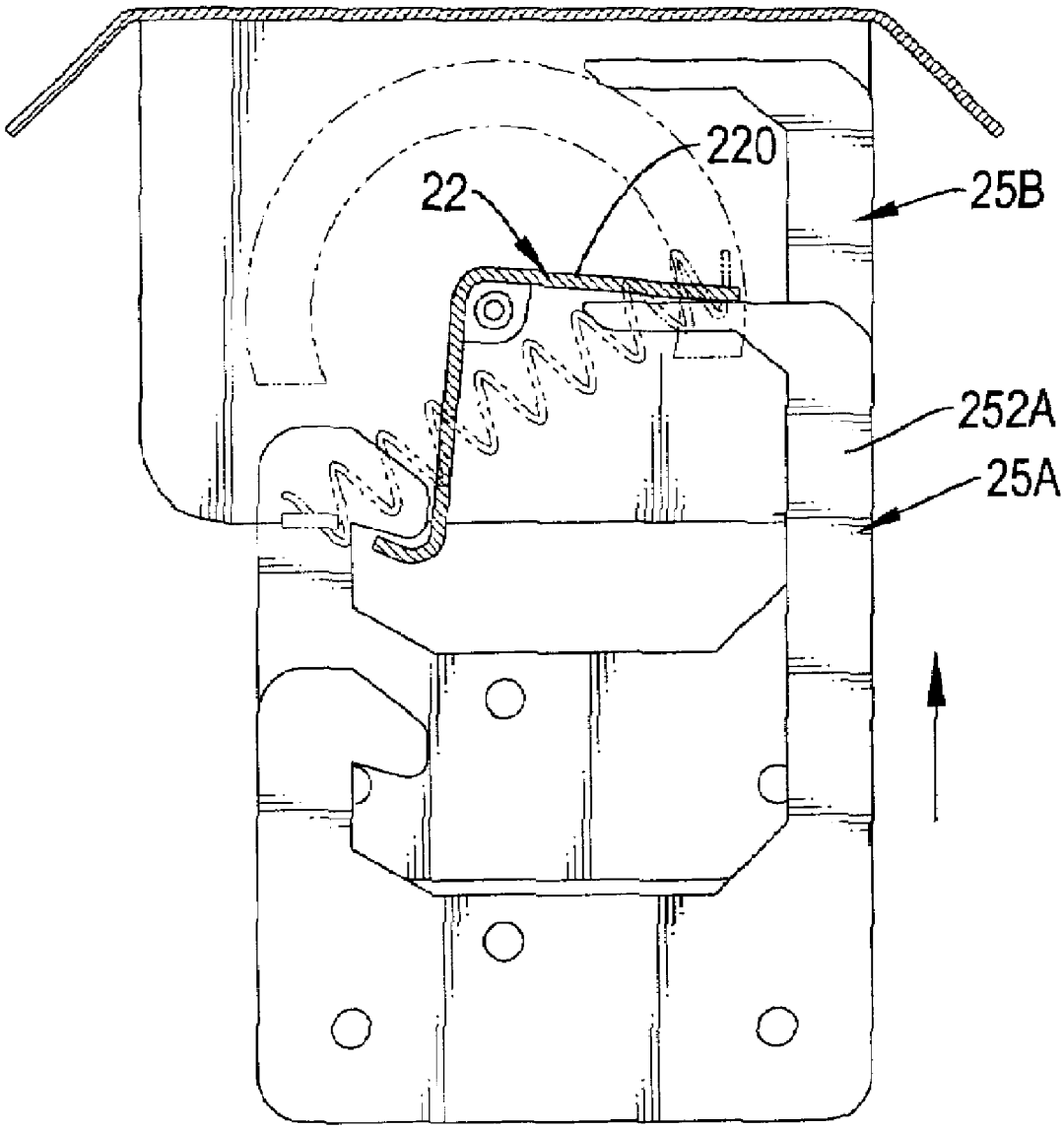
FIG. 8 is an operational top view in partial section of the safety device of the cabinet in FIG. 1.
Figure 9:
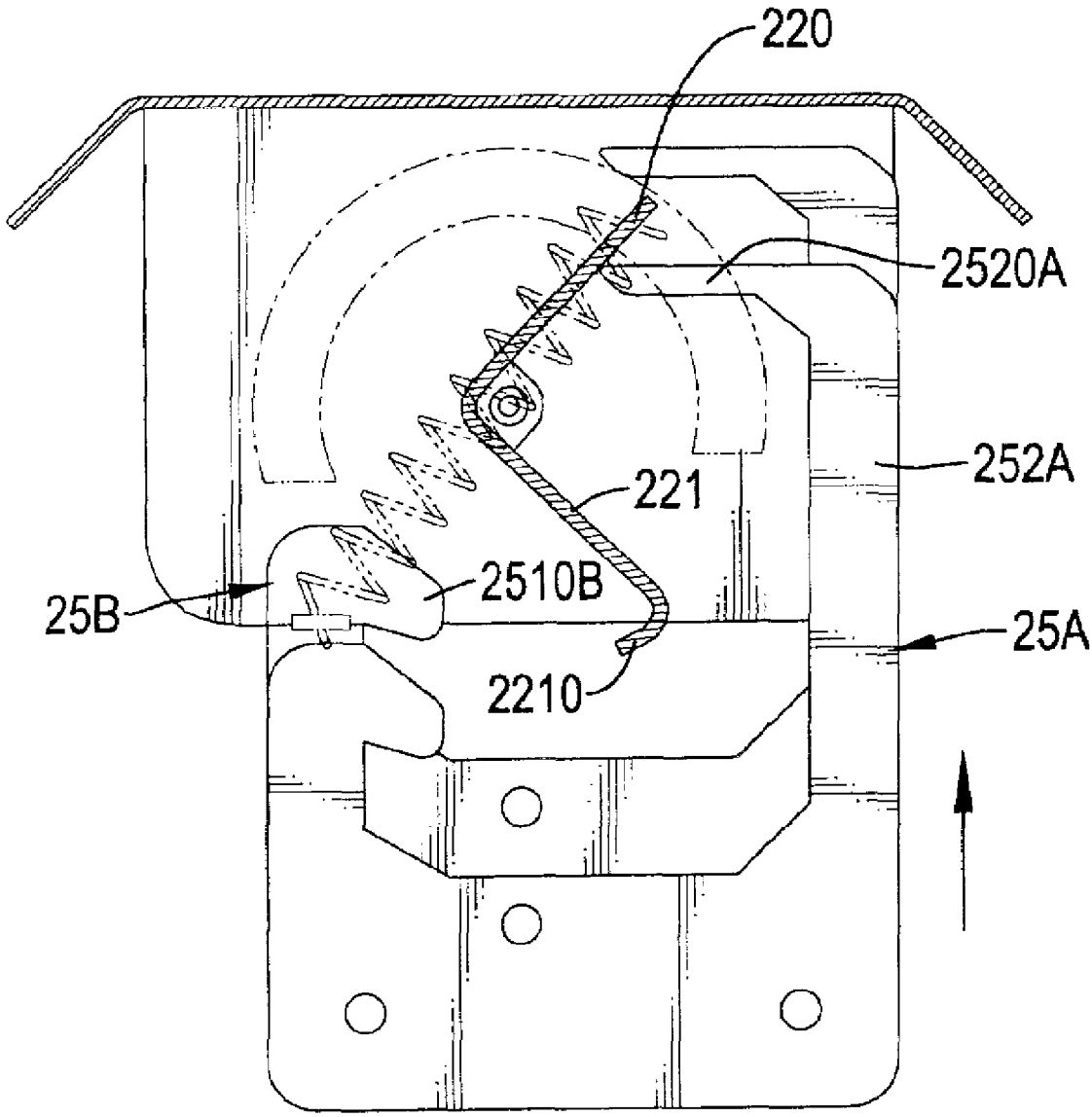
FIG. 9 is an operational top view in partial section of the safety device of the cabinet in FIG. 1.

With reference to FIGS. 8 and 9, when the opened drawer (11) is closed, the pushing protrusion (2520A) on the hook member (25A) pushes the guide sheet (220) of the pivotal member (22) to pivot the pivotal member (22). Consequently, the hook flange (225) on the hook sheet (221) disengages from the hook protrusions (2510B) on hook members (25B) on other drawers (11) to allow another drawer to be opened.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A cabinet comprising a cabinet body comprising a rear panel having an inner surface;

a top; and a bottom;

two side panels being mounted on the rear panel, each side panel having a top end; and a top panel being mounted on the top ends of the side panels;

multiple drawers being mounted moveably in the cabinet body; and a safety device being mounted in the cabinet body and comprising a control member being mounted on the rear panel and comprising a supporting base being mounted on the inner surface of the rear panel and having a supporting body being attached to the inner surface of the rear panel, extending from the top to the bottom of the rear panel and having a top end and a bottom end;

a top flange being mounted on the top end of the supporting body and having a front edge; and a bottom flange being mounted on the bottom end of the supporting body and having a top surface;

a pivotal member having a V-shaped cross-section, being mounted pivotally on the supporting base and comprising a guide sheet having a top edge and a bottom edge;

a hook sheet being attached to the guide sheet and having an outer edge, a top edge and a bottom edge;

a hook flange being formed on the outer edge of the hook sheet; and an included angle being defined between the guide sheet and the hook sheet; and a resilient element having a positioning end being connected to the supporting base; and a guide end being connected to the pivotal member; and multiple hook members being mounted respectively on the drawers and aligned with the pivotal member, each hook member comprising a short protrusion extending toward the rear panel and having a rear end;

a long protrusion extending toward the rear panel and having a rear end;

a hook protrusion being mounted on the rear end of the short protrusion; and a pushing protrusion being mounted on the rear end of the long protrusion and extending between the supporting base and the pivotal member when the corresponding drawer is closed, wherein when a drawer is opened, the pushing protrusion on a corresponding hook member pushes the hook sheet of the pivotal member to pivot the pivotal member and stretch the resilient element and the hook flange on the hook sheet engages the hook protrusions on the hook members on other drawers; and when an opened drawer is closed, the pushing protrusion on the corresponding hook member pushes the guide sheet of the pivotal member to pivot the pivotal member and the hook flange on the hook sheet disengages from the hook protrusions on the hook members on other drawers.

2. The cabinet as claimed in claim 1, wherein the supporting base further has a semi-circular guide slot defined through the top flange;

the pivotal member further comprises a guide protrusion formed on the top edge of the guide sheet and mounted moveably in the guide slot in the top flange; and the guide end of the resilient element is connected to the guide protrusion on the guide sheet of the pivotal member.

3. The cabinet as claimed in claim 2, wherein the supporting base further has a positioning protrusion formed on the front edge of the top flange; and the positioning end of the resilient element is connected to the positioning protrusion on the top flange on the supporting base.

4. The cabinet as claimed in claim 3, wherein each hook member further comprises a connecting base mounted on a corresponding drawer and having a hook side; and a pushing side;

the short protrusion is mounted on the hook side of the connecting base; and the long protrusion is mounted on the pushing side of the connecting base.

5. The cabinet as claimed in claim 4, wherein the supporting base further has a pivotal hole being defined through the top flange, wherein the guide slot is defined around the pivotal hole; and a stud being formed on the top surface of the bottom flange and aligned with the pivot hole in the top flange;

the pivotal member further comprises a top holder being mounted between the top edges of the guide sheet and the hook sheet and aligned with the pivotal hole in the top flange; and a bottom holder being mounted between the bottom edges of the guide sheet and the hook sheet and holding the stud on the bottom flange; and the control member further comprises a bolt being mounted in and extending through the pivotal hole in the top flange and the top holder on the pivotal member; and a nut engaging the bolt.

6. The cabinet as claimed in claim 1, wherein the supporting base further has a positioning protrusion formed on the front edge of the top flange; and the positioning end of the resilient element is connected to the positioning protrusion on the top flange on the supporting base.

7. The cabinet as claimed in claim 1, wherein each hook member further comprises a connecting base mounted on a corresponding drawer and having a hook side; and a pushing side;

the short protrusion is mounted on the hook side of the connecting base; and the long protrusion is mounted on to pushing side of the connecting base.

8. The cabinet as claimed in claim 2, wherein the supporting base further has a pivotal hole being defined through the top flange, wherein the guide slot is defined around the pivotal hole; and a stud being formed on the top surface of the bottom flange and aligned with the pivot hole in the top flange;

the pivotal member further comprises a top holder being mounted between the top edges of the guide sheet and the hook sheet and aligned with the pivotal hole in the top flange; and a bottom holder being mounted between the bottom edges of the guide sheet and the hook sheet and holding the stud on the bottom flange; and the control member further comprises a bolt being mounted in and extending through the pivotal hole in the top flange and the top holder on the pivotal member; and a nut being screwed on the bolt.

* * * * *